United States Patent [19]

Opitzer

[11] 3,942,589

[45] Mar. 9, 1976

[54] SHELL AND TUBE HEAT EXCHANGER

[75] Inventor: Rudolf Opitzer, Oberhausen, Germany

[73] Assignee: Deutsche Babcock & Wilcox Aktiengesellschaft, Oberhausen, Germany

[22] Filed: Mar. 28, 1973

[21] Appl. No.: 345,599

Related U.S. Application Data

[63] Continuation of Ser. No. 64,189, Aug. 17, 1970, abandoned.

[52] U.S. Cl. ..... 165/157; 165/176; 122/32

[51] Int. Cl.[2] ..... F28D 7/00

[58] Field of Search ..... 165/157, 145, 257; 122/32, 122/34

[56] References Cited

UNITED STATES PATENTS

| | | | |
|---|---|---|---|
| 1,883,605 | 10/1932 | Davy | 165/157 |
| 1,919,029 | 7/1933 | Lucke | 122/32 |
| 3,443,548 | 5/1969 | Rich et al. | 122/32 |

FOREIGN PATENTS OR APPLICATIONS

| | | | |
|---|---|---|---|
| 1,002,861 | 9/1965 | United Kingdom | 122/32 |

*Primary Examiner*—Charles J. Myhre
*Assistant Examiner*—Theophil W. Streule, Jr.
*Attorney, Agent, or Firm*—Roland T. Bryan

[57] ABSTRACT

An improved shell and tube heat exchanger is described wherein power steam for driving a turbine is reheated between successive stages of the turbine. The power steam passing through the shell is heated by heating steam passing through heating tubes, the exchanger being of the type having steam distribution elements including a main inlet header adapted to distribute heating steam to the heating tubes, a main outlet header located to collect the heating steam from the heating tubes, a plurality of pairs of inlet and outlet subheaders, feeder tubes for coupling each of the inlet and outlet subheaders to the main inlet header and main outlet header respectively, and heating tubes coupling the inlet and outlet subheaders of each pair. The heat exchanger is characterized by an improved arrangement of the distribution elements to provide improved allocation of the heating steam to uniformly heat power steam of varying moisture distribution and hence different local heat transfer requirements, without developing degenerative heat transfer conditions.

In the improved arrangement of distribution elements, each pair of inlet and outlet subheaders has a uniform number of heating tubes in relation to the quantity of heating steam applied by the feeding tubes coupled to that pair, to provide a uniform quantity of heating steam for each heating tube, whereby power steam of varying moisture distribution is heated with steam pressure loads remaining substantially independent of heat transfer variations in the individual heating tubes.

7 Claims, 7 Drawing Figures

6

HSo
4o
5o
5o
PSi
3o
2
7
7
1
3i
5i
4i
5i
HSi
6
PSo

SHELL AND TUBE HEAT EXCHANGER

CROSS-REFERENCE TO RELATED APPLICATION

This is a continuation of application Ser. No. 64,189, filed August 17, 1970 now abandoned.

BACKGROUND OF THE INVENTION

1. Field of the Invention

This invention relates to the field of shell and tube heat exchangers. More specifically, this invention relates to shell and tube heat exchangers as are used in nuclear powered electricity producing plants.

In a nuclear power plant super-heated power steam is commonly employed to drive a turbine which is connected to an electric generator. After passage through one or several stages of the turbine, water is likely to condense in the stream of power steam. Hence, the power steam is reheated after passing through a turbine stage before the power steam is permitted to return to the next successive turbine stage. The power steam, after performing its work on the first turbine stage, is first passed through a water droplet separator and then reheated for instance in a shell and tube heat exchanger before returning to the next successive stage in the turbine.

2. Description of the Prior Art

Various shell and tube heat exchangers are known in the art, as shown by, e.g., U.S. Pat. Nos. 1,883,605 to Davy, and 3,443,548 to Rich et al.

A shell and tube heat exchanger of the type known to the prior art for reheating steam is depicted in FIGS. 1 and 2 with a cylindrical shell 1 having power steam inlet PS*i* and outlet PS*o* and enclosing a heating system formed of a cylindrical arrangement of longitudinally aligned heating tubes 2 which are supplied with heating steam from an inlet HS*i* through a main inlet manifold 4*i*, inlet feeders 5*i* and inlet subheaders 3*i*. The heating steam, after passing through heating tubes 2, passes through outlet subheaders 3*o*, outlet feeders 5*o* and main outlet manifold 4*o* to heating steam outlet HS*o*. With such shell and tube heat exchangers, the inclusion of condensed water in the power steam tends to produce heat starved heating tubes in a degradating process that tends to repeat itself in a cyclic manner.

For example, a sudden increase in the load on the turbine reduces the power steam temperature to a level where the condensed water in the stream is not sufficiently removed by the separator and permitted to enter the reheater shell and tube heat exchanger. The water-containing power steam, as it passes through the shell and tube heat exchanger, contacts a heating tube. This water-contacting heating tube then commences to operate as an evaporator rather than as a steam heater. The evaporator function of the heating tube causes the latter to operate at substantially constant temperature and draws an unusually large amount of heat from the heating steam within the heating tube with the result that heating steam condenses in the heating tube. As the condensate in the heating tube continues to build up, it draws less heating steam and effectively becomes heat starved. The build up of condensate in a heating tube is reflected in pressure losses in the feeder which supplies heating steam to the heat starved condensate-containing heating tube. In effect pressure loss in the feeders introduces non-uniform heating of the power steam as it passes through the shell and introduces "cold strands" of power steam. These cold strands are not adequately dispersed throughout the stream of power steam by the time the next successive turbine stage is reached and water droplets are likely to enter the turbine causing damage to turbine blades.

In effect, therefore, the presence of water in the power steam introduces an unbalanced condition on both the shell and tube sides of the heat exchanger.

SUMMARY OF THE INVENTION

Objects of the present invention are to provide a shell and tube heat exchanger in which the supply of heating steam to the heating tubes is maintained substantially independent of whether the power steam includes condensed water droplets and in which, as a result, heating tubes contacted by water in the power steam are unable to cause pressure variations which would produce cold strands in the power steam. As a result, the entire plant is advantageously operated with improved control.

According to the invention, the shell and tube heat exchanger is of the type having steam distribution elements including a main inlet header adapted to distribute heating steam to the heating tubes, a main outlet header located to collect the heating steam from the heating tubes, a plurality of pairs of inlet and outlet subheaders, feeder tubes for coupling each of the inlet and outlet subheaders to the main inlet header and main outlet header respectively, and heating tubes coupling the inlet and outlet subheaders of each pair. The heat exchanger is characterized by an improved arrangement of the distribution elements to provide improved allocation of the heating steam in which: each pair of inlet and outlet subheaders has a uniform number of heating tubes in relation to the quantity of heating steam applied by the feeding tubes coupled to that pair, to provide a uniform quantity of heating steam for each heating tube, whereby power steam of varying moisture distribution is heated with steam pressure loads remaining substantially independent of heat transfer variations in the individual heating tubes. In further aspects of the invention each feeder tube coupling the main inlet header to a subheader supplies a uniform quantity of heating steam to the subheader, and each pair of inlet and outlet subheaders has effectively the same number of heating tubes for each feeder tube coupled thereto.

In one form, the shell and tube heat exchanger is arranged so that every pair of inlet and outlet subheaders in the shell has the same number of heating tubes and the same number of feeder tubes, and the inlet and outlet subheaders are of substantially the same length and are arranged in a rectangular parallelpiped configuration.

In another form, the shell and tube heat exchanger is arranged with at least two groups of pairs of inlet and outlet subheaders, the pairs or one group each having a first number of feeder tubes coupling the main inlet and outlet headers thereto and a corresponding number of heating tubes, and the pairs of the other group each having a second different number of feeder tubes coupling the main inlet and outlet headers thereto and a second different corresponding number of heating tubes, the inlet and outlet subheaders of said one group being substantially of one length and are arranged in a rectangular configuration and the inlet and outlet subheaders of said other group being substantially of another length and are arranged in a second rectangular configuration.

Accordingly, one significant difference between the present invention and the prior art is that whereas the prior art device (FIGS. 1 and 2) spatially distributes the heating tubes uniformly over the cross-section of shell 1, the present invention instead uniformly distributes the supply of heating steam over the number of heating tubes and obtains a polygonal arrangement of heating tubes within a cylindrical shell.

Other objects, aspects and advantages of the invention will be pointed out in, or apparent from, the detailed description hereinbelow, considered together with the following drawings.

DESCRIPTION OF THE PREFERRED EMBODIMENTS

Shell and tube heat exchangers in accordance with the present invention ameliorate a hitherto unrecognized problem caused by the construction of prior art heat exchangers.

Figure 1:
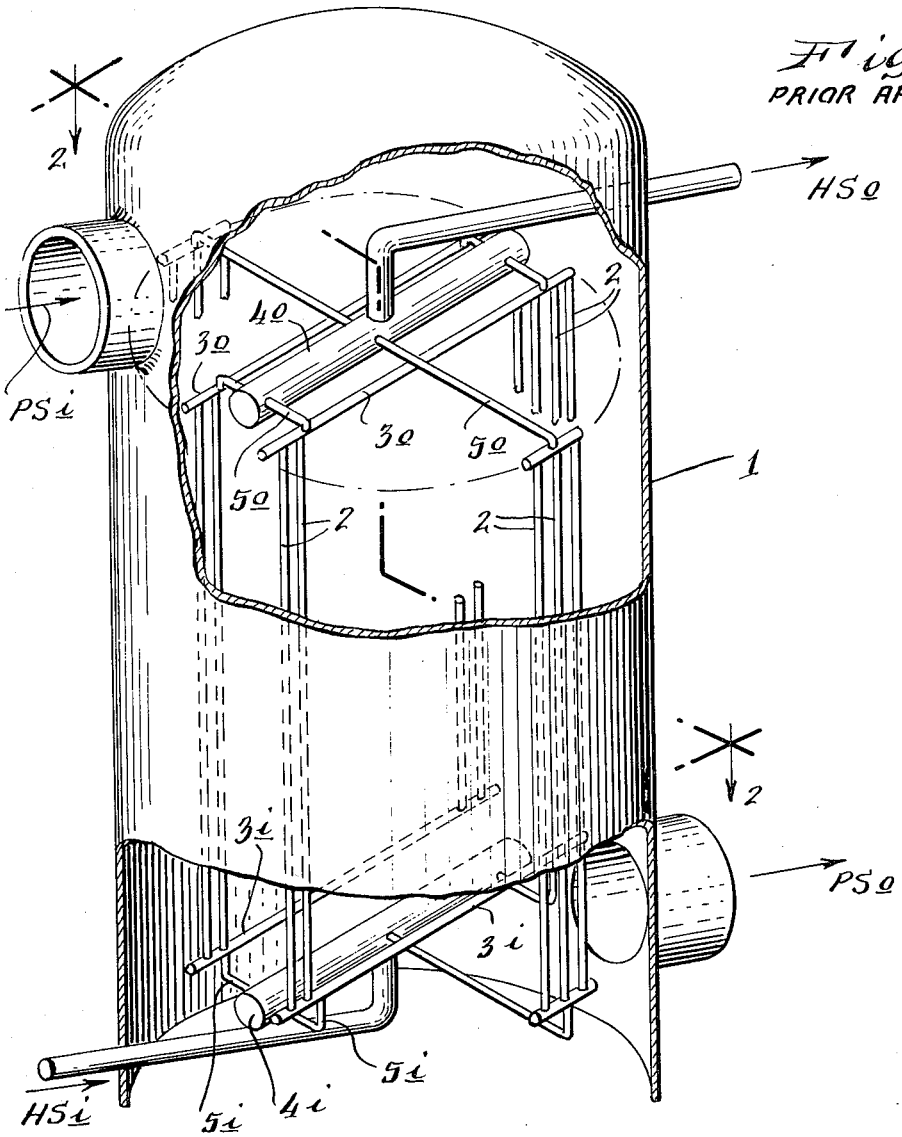
Fig. 1. PRIOR ART
FIGS. 1 and 2 illustrate a prior art shell and tube heat exchanger, FIG. 1 being a perspective view with portions broken away, and FIG. 2 a section on line 2—2 of FIG. 1, the upper half of the cross section illustrating an end view at the outlet of the heat exchanger and the lower half section view being taken through an intermediate axial portion of the heat exchanger to reveal the heating tubes.
Figure 2:
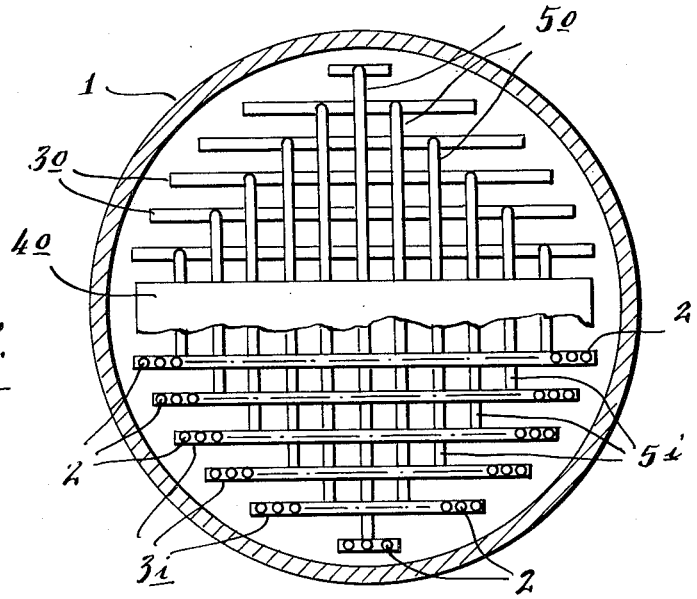
Fig. 2. PRIOR ART

In prior art heat exchangers as illustrated in FIGS. 1 and 2, shell 1 is cylindrical and encloses a number of heating tubes 2 axially arranged and collectively forming a cylinder. Heating tubes 2 are grouped for connection in rows to pairs of subheaders 3*i* and 3*o*. The subheaders are of different sizes and lengths depending upon their location within the cylindrical shell housing 1. Each of the subheaders serves a different number of heating tubes 2 in comparison with other adjacent subheaders.

As previously explained, a shell and tube heat exchanger as depicted in FIGS. 1 and 2 is sensitive to variations in the pressure of a heating tube. For example, if one of the heating tubes 2 in the uppermost subheader presents an increased pressure drop, the feeders 5*i* and 5*o* coupled thereto are affected by this pressure change. Accordingly, the entire subheader and heating tubes connected to it are operatively different from adjacent subheaders and the described undesirable cold strands are produced. This degenerate effect is particularly pronounced with subheaders having relatively few heating tubes connected to them.

Figure 3:
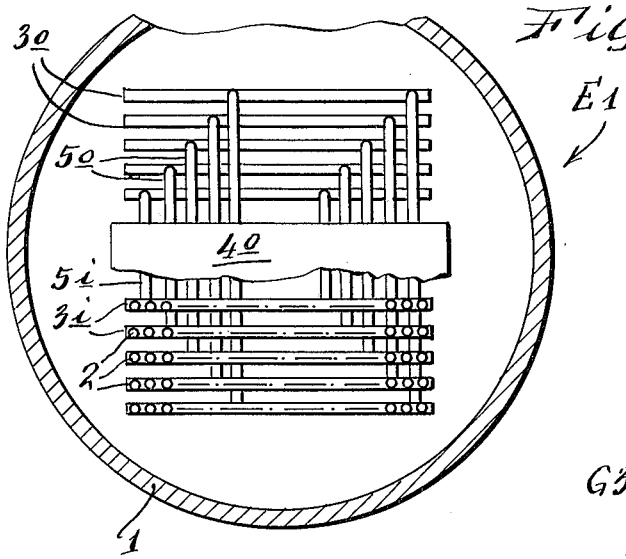
FIG. 3 is a section similar to FIG. 2 illustrating in essentially schematic form an arrangement of steam distribution elements according to the present invention.

An improved shell and tube heat exchanger E1 in accordance with the invention is depicted in FIG. 3. In exchanger E1, the subheaders 3*i* and 3*o* are all made of the same length for connection to the same number of heating tubes 2. Subheaders 3*i* and 3*o* are arranged in a square cross-sectional space within a cylindrical shell 1, and thus heating tubes 2 form a rectangular parallelpiped. Feeders 5*i* and 5*o*, joining main headers 4*i* and 4*o* to the subheaders 3*i* and 3*o*, have the same cross-section as that of subheaders 3*i* and 3*o* and in this embodiment have the same diameter. As a result, the heating steam supplied to subheaders 3*i* remains substantially the same independent of pressure variations in any one of the heating tubes 2.

Figure 4:
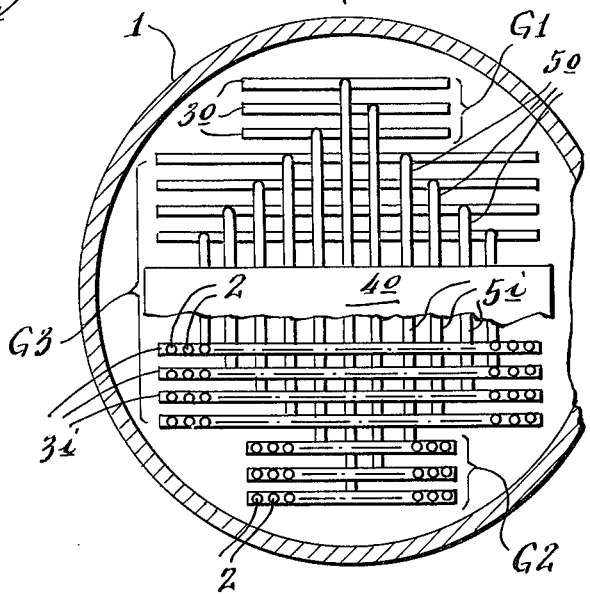
FIG. 4 is another section similar to FIG. 2 illustrating in essentially schematic form another arrangement of steam distribution elements according to the present invention.

In shell and tube heat exchanger E2 illustrated in FIG. 4, an improved utilization of the cylindrical heat exchanger shell 1 is obtained. The subheaders 3*i* and 3*o* are arranged in three groups of like lengths. Upper and lower groups G1 and G2 of smaller subheaders of like length located adjacent one another are connected to the main headers 4*i* and 4*o* each by a single pair of feeder tubes 5*i* and 5*o*. The centrally located subheaders are arranged in a group G3 of like length alongside one another and each is connected to the main headers 4*i* and 4*o* by two pairs of feeders 5*i* and 5*o*. In the embodiment of FIG. 4 the heating steam is supplied uniformly to the subheaders relatively independently of degrading heating performance in any heating tube.

Figure 7:
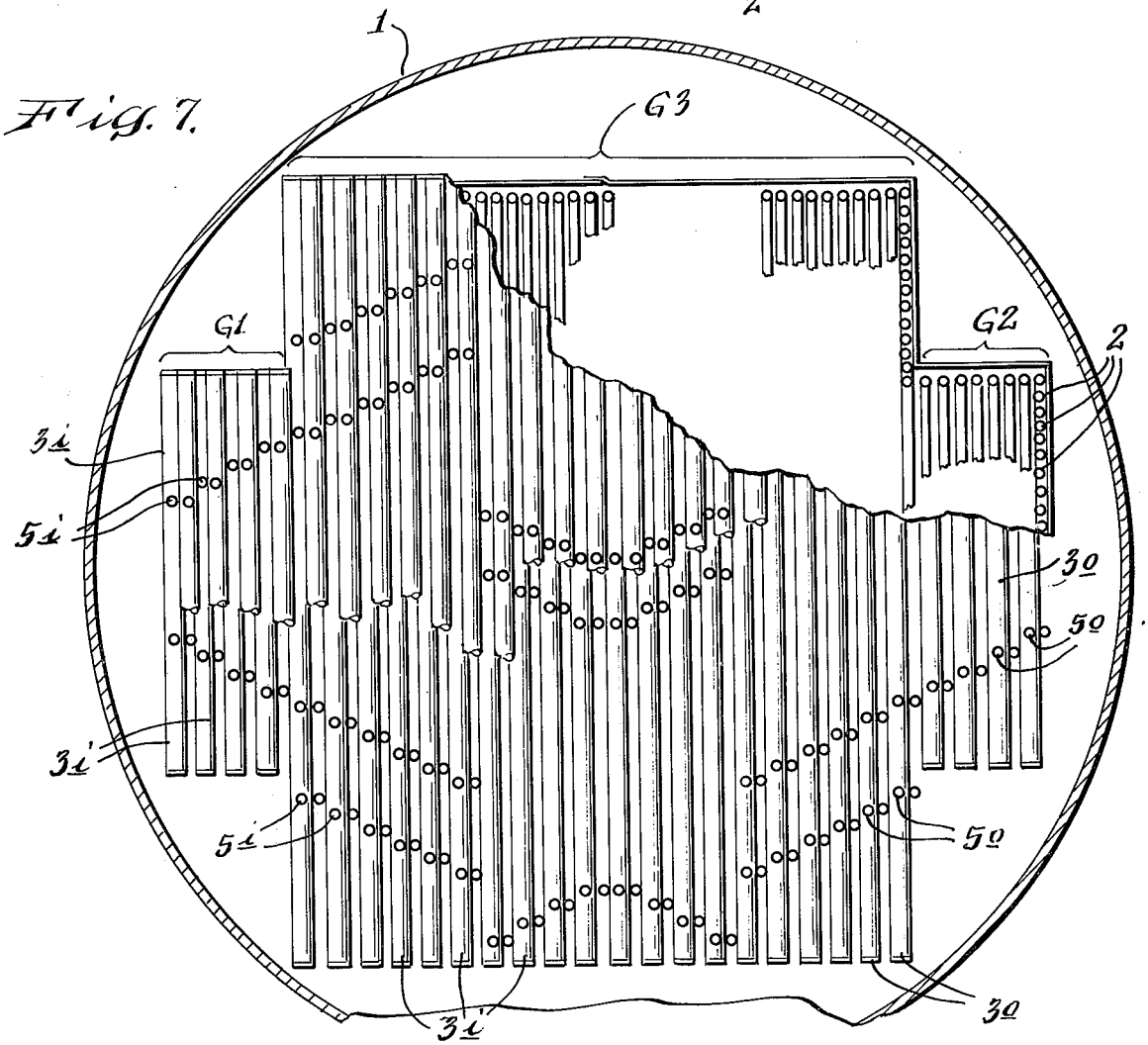
FIG. 7 is a section on line 7—7 of FIG. 5.
Figure 5:
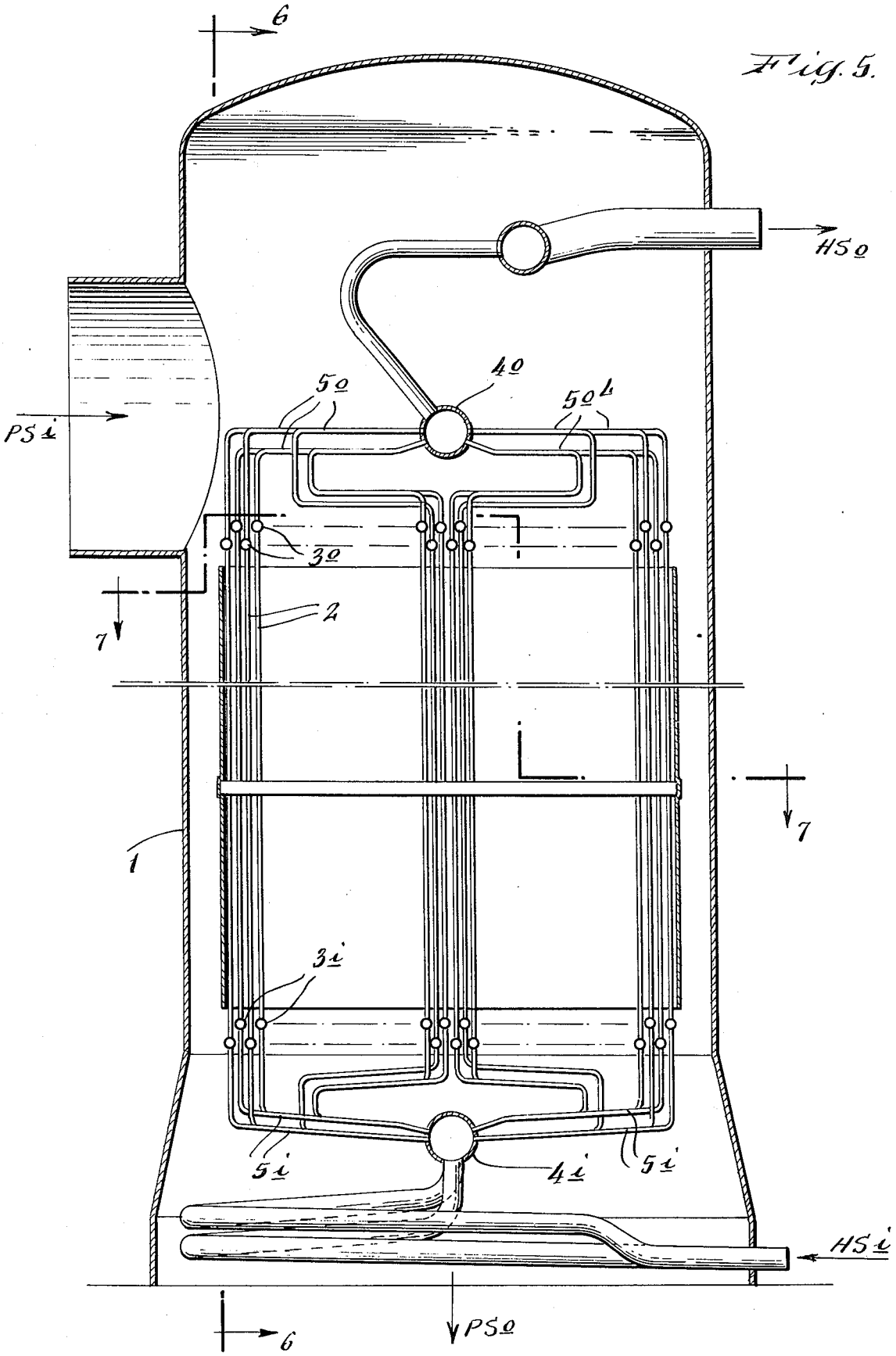
FIG. 5 is a sectional elevation of a shell and tube heat exchanger of the type illustrated in FIG. 4.
Figure 6:
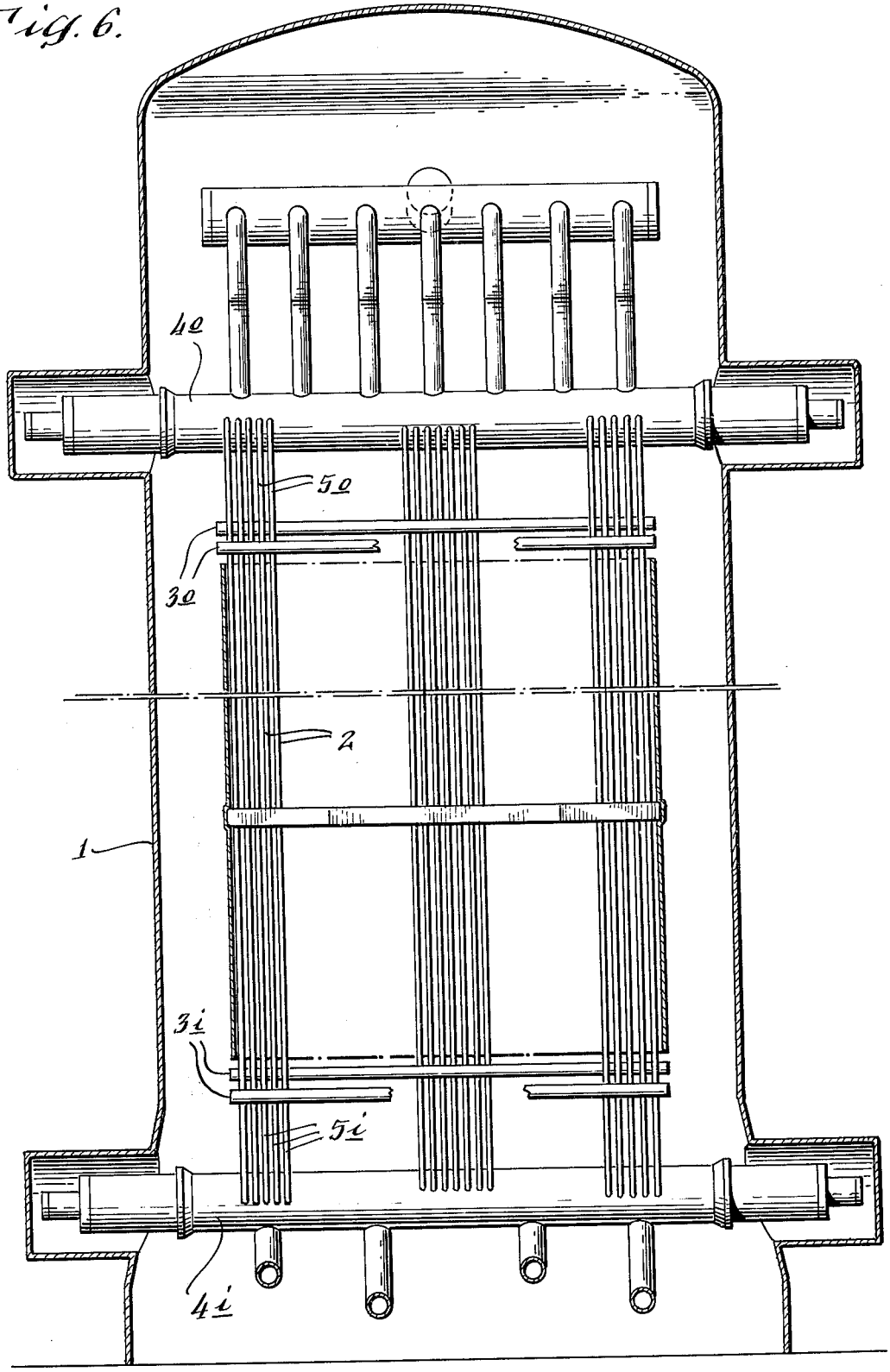
FIG. 6 is a section on line 6—6 of FIG. 5.

FIGS. 5 through 7 illustrate a shell and tube heat exchanger E3 similar to exchanger E2, but in which the outer groups G1 and G2 of subheaders are connected to two pairs of feeder tubes 5*i* and 5*o* (see FIG. 7) and the central group G3 of subheaders is connected to four pairs of feeder tubes 5*i* and 5*o*. The shell and tube heat exchanger E3 of FIGS. 5–7 shows various details of construction of a practical embodiment of the present invention, with steam distribution elements corresponding to those described above being labelled with corresponding numerals.

Having thus described an improved shell and tube heat exchanger, its advantageous reduced sensitivity to pressure variations in a heating tube accompanied by improved plant system control by maintaining heat inbalances to the shell side of the heat exchanger will be understood.

Although specific embodiments of the invention have been disclosed herein in detail, it is to be understood that this is for the purpose of illustrating the invention, and should not be construed as necessarily limiting the scope of the invention, since it is apparent that many changes can be made to the disclosed structures by those skilled in the art to suit particular applications.

I claim:

1. A shell and tube heat exchanger arranged to uniformly heat power steam of varying moisture distribution and hence different local heat transfer requirements, without degenerative heat transfer conditions arising as the power steam passing through the shell is heated by heating steam passing through heating tubes, the exchanger being of the type having steam distribution elements including a main inlet header adapted to distribute heating steam to the heating tubes, a main outlet header located to collect the heating steam from the heating tubes, a plurality of pairs of inlet and outlet subheaders, feeder tubes for coupling each of the inlet and outlet subheaders to the main inlet header and main outlet header respectively, and heating tubes coupling the inlet and outlet subheaders of each pair, said heat exchanger being characterized by an improved arrangement of the distribution elements to provide improved allocation of the heating steam in which:

the cross-sectional area of the flow paths in the feeder tubes is substantially the same, the length of each of the inlet subheaders per feeder tube connected thereto is substantially the same, and there are substantially the same number of heating pipes per unit length of inlet subheader whereby power steam of varying moisture distribution is heated with steam pressure loads remaining independent of heat transfer variations in the individual heating tubes.

2. The improved shell and tube heat exchanger as claimed in claim 1 wherein every pair of inlet and outlet subheaders in the shell has the same number of heating tubes and the same number of feeder tubes.

3. The improved shell and tube heat exchanger as claimed in claim 2 wherein said inlet and outlet subheaders are of substantially the same length and are arranged in a rectangular configuration.

4. The improved shell and tube heat exchanger as claimed in claim 1 wherein at least two groups of pairs of inlet and outlet subheaders are provided in the shell, the pairs of one group each having a first number of feeder tubes coupling the main inlet and outlet headers thereto and a corresponding number of heating tubes, and the pairs of the other group each having a second different number of feeder tubes coupling the main inlet and outlet headers thereto and a second different corresponding number of heating tubes.

5. The improved shell and tube heat exchanger as claimed in claim 4 wherein the cross-sectional area of the feeder tubes is effectively the same as the cross-sectional area of the subheaders and wherein the inlet and outlet subheaders in said one group are substantially of one length and are arranged in a rectangular configuration and wherein the inlet and outlet subheaders in said other group are substantially of another length and are arranged in a second rectangular configuration.

6. A shell and tube heat exchanger arranged to uniformly heat power steam of varying moisture distribution and hence different local heat transfer requirements, without degenerative conditions arising as the power steam passing through a cylindrical shell is heated by heating steam passing through heating tubes, the heat exchanger being of the type having steam distribution elements including a main inlet header adapted to distribute heating steam to the heating tubes, a main outlet header located to collect the heating steam from the heating tubes, a plurality of pairs of inlet and outlet subheaders, feeder tubes for coupling each of the inlet and outlet subheaders to the main inlet header and main outlet header respectively, and heating tubes of like length coupling the inlet and outlet subheaders of each pair, the heat exchanger being characterized by an improved arrangement of steam distribution elements, providing improved allocation of heating steam, in which:

the flow area of each feeder tube is the same as the flow area of each subheader, the inlet and outlet subheaders are arranged in at least one group of adjacent subheaders of like length forming a rectangular configuration, each pair of subheaders in a rectangular group is coupled by the same number of heating tubes, and the heating tubes which couple the subheaders of a rectangular group form a rectangular parallelpiped, whereby power steam of varying moisture distribution is heated while the heating steam supplied to the subheaders in a group remains substantially the same independently of pressure variations in any one of the heating tubes.

7. The improved shell and tube heat exchanger as claimed in claim 6 wherein at least two rectangular groups of subheaders are provided, the two groups having subheaders of different length, and different numbers of heating and feeder tubes coupled thereto, every rectangular group having its pairs of inlet and outlet subheaders connected to a number of heating tubes related to the quantity of steam supplied by the feeder tubes coupled to that pair to provide a uniform quantity of heating steam per heating tube among the different groups, whereby the heating system supplied to the subheaders in the two groups is substantially independent of pressure variations in any one of the heating tubes.

* * * * *